United States Patent [19]

Hirsch

[11] 4,227,926

[45] Oct. 14, 1980

[54] METHOD FOR PRODUCING HIGH DENSITY AND HIGH CONDUCTIVITY METAL PRESSINGS

[75] Inventor: Harold H. Hirsch, Schenectady, N.Y.

[73] Assignee: General Electric Company, Schenectady, N.Y.

[21] Appl. No.: 954,208

[22] Filed: Oct. 24, 1978

[51] Int. Cl.[2] ..... B22F 3/00; B22F 3/26; B22F 3/12

[52] U.S. Cl. ..... 75/200; 75/211; 75/221

[58] Field of Search ..... 75/200, 211, 221

[56] References Cited

U.S. PATENT DOCUMENTS

| | | | |
|---|---|---|---|
| 3,996,047 | 12/1976 | Nayar | 75/200 |
| 4,113,480 | 9/1978 | Rivers | 75/211 |
| 4,132,547 | 1/1979 | Buzzelli et al. | 75/200 |

*Primary Examiner*—Brooks H. Hunt

*Attorney, Agent, or Firm*—Leo I. MaLossi; James C. Davis, Jr.

[57] ABSTRACT

High density and high conductivity metal pressings of normally soft and reducible metals such as copper are produced by impregnating the voids of the metal pressing to permit all gases to be expelled before the pores are closed during the sintering operation.

12 Claims, No Drawings

METHOD FOR PRODUCING HIGH DENSITY AND HIGH CONDUCTIVITY METAL PRESSINGS

BACKGROUND OF THE INVENTION

It is extremely difficult if not impossible to press and sinter large cross-section soft ductile metal parts having surface and internal compounds which are readily reduced by hydrogen from high purity powder e.g., copper, and obtain high electrical conductivity, i.e., above 92% IACS (International Annealed Copper Standard) throughout the part. It is not unusual to attain a high surface conductivity in a part but attaining a high interior conductivity is quite a bit more difficult. This is largely a matter of controlling the density since the conductivity decreases in approximately a linear fashion with an increase in void volume. Clearly no powder part can achieve a high sintered density if the compacting pressure is so low that a multitude of large pores exist in the green or as-pressed part. With less ductile powders it then becomes simply a matter of increasing the pressure to a practical maximum level. The higher the compacting pressure the higher will be the green density and subsequently the sintered density. However, with ductile powders such as copper, a critical pressure is soon reached beyond which further pressure increase results in an expansion, swelling and even blistering upon sintering. This critical pressure will vary some with the characteristics of the metal powder but in all cases it limits the maximum sintered density of metal powders to that internal conductivities of pressed and sintered parts rarely get above 90% IACS.

It is believed that the cause of swelling that occurs in compacts pressed above the critical pressure is due to early cessation of communication between surface and interior pores. If this occurs before all internal gases, whether present on or within the powder particles or generated by reaction of a reducing gas such as hydrogen with reducible oxides (e.g., oxides of copper, iron, nickel), have escaped from the interior of the compact, swelling and blistering, etc., will occur. The premature closure of the exterior pores is abetted by the smaller voids engendered by the higher pressures, the smearing-densification action of the metal particles located on the periphery of the part next to the die wall, and early sintering of the exterior metal particles due to earlier exposure to the heat and clean-up sintering atmosphere. When blisters occur, very much larger voids are formed.

It was believed that the critical pressure could be raised if in some way the outer pores could maintain their communication with the interior structure and the outside world until substantially all gases are eliminated (except for gases which can readily diffuse through the solid metal such as hydrogen through copper) and then all pores would be allowed to sinter to their minimum volume. It was felt that this concept would be best carried out by using a decomposable or volatile salt which if it left any residue would be both small in volume and insoluble in the metal. This salt could be introduced by admixing with the metal powder before pressing or impregnated into the green compact with an appropriate solution of the salt. This latter technique places the salt exactly where it is required but, of course, the amount of salt that can be introduced is limited by its solubility in the liquid vehicle. For the impregnation method to work the pores at the surfaces cannot be smeared shut by the pressing action or the presence of a wall lubricant. Also some interconnected porosity must exist from surface to interior again limiting the maximum pressure but to higher values than hithertofore. Another critical aspect of the concept is the rate at which the sintering temperature is reached. The decomposition of the salt has to be controlled so that it maintains the interconnection of the pores just long enough to allow all gases to escape and then having done its job must in turn depart without interfering with completion of the sintering operation or itself causing swelling or blistering.

BRIEF DESCRIPTION OF THE INVENTION

It has now been discovered that both the density and electrical conductivity of a ductile and easily reducible metal such as copper can be increased. More particularly, it has been found that this can be accomplished by impregnating the voids or pores of a pressed powder part with a material that keeps the pores of the pressing open until substantially all gases are expelled and which can then be removed during the sintering operation before pore closure. The impregnant, which can be any of a number of metal salts, is such that it will not alloy with the metal pressing and can be deposited from a suitable solvent such as water, preferably by submerging the pressing in the solution. The pressing is then subjected to a sintering schedule comprising raising the temperature in stages to produce an increased density and electrical conductivity.

DETAILED DESCRIPTION OF THE INVENTION

Normally soft and easily reproducible metals which can be employed in the process of the invention include copper, gold, silver, platinum and their alloys.

The metal is first pressed to the desired form and green strength employing conventional equipment. Generally, the green density should be such that the void volume falls in the range of between about 8% and about 20% and preferably is between 8% and 14%.

The pressing is then treated with an impregnant which will keep the voids or pores open to allow entrapped gases, engendered water vapor and other contaminants to be expelled during the early stages of sintering so as to obviate swelling of the pressing during the later stages of sintering. Swelling of the pressing occurs due to entrapped gases and water vapor formed by hydrogen diffusing into the pressing and reacting with residual oxygen and reducible oxides. While hydrogen can readily diffuse through soft metals such as copper, the larger water vapor molcules cannot. At the sintering temperatures generally between 700° and 1000° C. these gases and vapors develop high pressures and can easily cause the hot, soft metal to swell or blister.

The particular impregnant employed will depend on the composition of the pressing, its diffusability into the pores of the pressing, its affinity or reactivity for the pressing, and its decomposition or volitilization characteristics. Thus the impregnant must keep the pores of the pressing open at the lower range of the sintering temperature, below about 400°-500° C. to permit the gases to be expelled, be non-reactive with the metal pressing, and be capable of being expelled itself at the higher end of the sintering range, i.e., above about 600°-700° C. or prior to the closure of the metal pores. Any residue left behind by the impregnant or its solvent must not interfere with the ultimate densification of the pressing or react with it to affect its conductivity. Thus the impregnant for any metal is best determined by thermogravimetric means. With a thermogravimetric balance, the loss in weight versus time and temperature for the particular powder can be plotted to determine when water and all other gases are expelled. This then determines the volitilization characteristics the impregnant must possess. The thermogravimetric balance is then again employed to determine whether a selected impregnant has these decomposition characteristics.

Exemplary of suitable impregnants are salts of lithium, copper, zinc, and ammonium such as lithium nitrate, lithium stearate, lithium formate, lithium acetate, lithium sulfate, ammonium heptamolybdate, ammonium heptatungstate, copper acetate, copper formate, copper nitrate, copper sulfate, ammonium acetate, ammonium sulfate, zinc sulfate, zinc acetate, zinc nitrate, zinc formate, and the like. Lithium nitrate and ammonium heptamolybdate are preferred impregnants.

The impregnant used should be one that will not form an alloy with the base metal. For example, salts of iron, nickel, cobalt, and silver should not be used with copper. The impregnants can be used singly or in combination with a solvent inert to the metal such as water; alcohol, such as methanol, ethanol, and propanol, ketone such as acetone; acetate, such as butyl acetate, amyl acetate, and the like. The concentration of solute will depend on the particle size, the particular impregnant, the diffusion rate and metal employed but generally between about 25% and about 100% of saturation is sufficient and most preferably between about 50% and about 100% of saturation.

A powdered metal can be mixed with a powdered impregnant and the composite pressed to the desired shape but for best results a pressed powdered metal compact is impregnated with a solution of the impregnant preferably by submerging the pressing in the solution. By reducing the pressure or evacuating the system, substantially all of the air can be removed from the pores of the pressing and then backfilled with air at or higher than atmospheric pressure to force the impregnant solution into the empty pores.

The pressing is then subjected to a sintering schedule comprising raising the temperature in stages, first to remove surface water, water of hydration from the impregnant and decompose the surface reaction products of the metal and atmosphere. Secondly, the temperature is raised to expel substantially all gases from within the metal, then it's raised further to expel substantially all of the impregnant, and finally, it is raised to the ultimate sintering temperature to close substantially all pores or voids so as to increase both the density and electrical conductivity of the pressing. To inhibit oxidation of the pressing, the method is conducted in the presence of a suitable atmosphere such as hydrogen, carbon monoxide, a vacuum, or an inert atmosphere such as nitrogen or argon.

The sintering schedule will depend upon the metal and impregnant employed. Generally, however, a first stage is employed at a temperature of between about 60° C. and about 150° C. for a period of between about 5 minutes and about 30 minutes. The second stage is generally between about 150° C. and about 425° C. for a period between about 5 minutes and about 30 minutes, the third stage generally between about 450° C. and about 700° C. for a period between about 5 minutes and about 30 minutes, and a fourth stage generally between about 850° C. and about 1050° C. for a period between about ½ hour and about 2 hours.

The following examples will serve to illustrate the invention and preferred embodiments thereof. All parts and percentages in said examples and elsewhere in the specification and claims are by weight unless otherwise specified.

EXAMPLES

Employing high grade copper powder produced by electrolysis (AMAX Grade LO) compacts were prepared as follows. The powder was pressed employing a 19 mm diameter hardened steel die. The walls of the die were lubricated with 10% solution of cetyl alcohol dissolved in isopropyl alcohol which was allowed to dry before loading the copper powder. The pressed compacts or discs were baked at 200° C. in hydrogen for 30 minutes to remove the cetyl alcohol and then submerged in the impregnation solution held in a vacuum dessicator. A vacuum of 30 torr was applied for two hours after which one or six atmospheres of pressure was admitted to the chamber for a period of another two hours to drive the liquid into the now evacuated interconnected pores of the compacts. The compacts were wiped dry and then baked 30 minutes at both 60° C. and 90° C. in flowing hydrogen to dry the impregnant and remove water of hydration. The compacts were then weighed to determine the amount of impregnant picked up. Sintering was carried out in an inconel furnace through which a −50° C. dew point hydrogen gas was passed. The compacts rested on a bed of high purity alumina grain contained in a molybdenum boat. The sintering schedule consisted of heating and holding the boat load after the 60° and 90° bake outs for 15 minutes at 400° C. and 650° C. and 60 minutes at 1000° C. The densities of the sintered discs were determined by the displacement technique using high purity methyl alcohol as the immersion fluid. The percent voids were calculated using the previously determined full density of each powder after pressing, sintering, hot rolling at 700° C. to reduce the thickness 50% and cold rolling to reduce the thickness another 50%. The conductivities at the center and surface of the discs were determined using an eddy current flux meter (Magnatest Conductivity Meter FM-120 manufactured by the Magnaflux Corporation of Chicago, Ill.). This device uses a flat headed probe and requires a flat surface having a minimum diameter of 12 mm. The center conductivity was determined by cutting the 10–11 mm thick sintered discs transversely so that one of the cut faces so exposed is at half the thickness of the original sintered disc.

| COMPACTING PRESSURE | IMPREGNANT AND CONCENTRATION | SINTERED PROPERTIES | | |
|---|---|---|---|---|
| | | | % ICAS | |
| | | % Void | Surface | Center |
| 45 TSI | Lithium nitrate - 25 grams/ 100 cc $H_2O$ | 5.4 | 88.1 | 86.2 |
| " | Lithium nitrate - 25 grams/ 100 cc $H_2O$ | 5.5 | 92.1 | 88 |

-continued

| COMPACTING PRESSURE | IMPREGNANT AND CONCENTRATION | SINTERED PROPERTIES % Void | % ICAS Surface | % ICAS Center |
|---|---|---|---|---|
| " | AHM* - 18 grams/ 100 cc $H_2O$ | 7.3 | — | — |
| " | AHM - 32 grams/ 100 cc $H_2O$ | 5.8 | 85.1 | 89.1 |
| 50 TSI | AHM - 32 grams/ 100 cc $H_2O$ | 6.6 | 91.5 | 84 |
| 45 TSI | Lithium nitrate - 11 grams/ 100 cc $H_2O$ | 16 | — | — |
| " | Lithium nitrate - 22 grams/ 100 cc $H_2O$ | 12-½ | — | — |
| " | Lithium formate - 11 grams/ 100 cc $H_2O$ | 9-½ | — | — |
| " | Lithium Formate - 22 grams/ 100 cc $H_2O$ | 8 | — | — |
| " | None | 17 | — | — |
| 50 TSI | " | 20 | — | — |
| 40 TSI | " | 10.4 | 86 | 82 |
| 35 TSI | " | 10.4 | 86 | 82 |

*AHM is ammonium heptamolybdate

From the data reported in the table it can be seen that all of the impregnant treated samples have a lower percentage of voids or higher density than the untreated sample. Conductivity measurements were not made for the lower density materials since the conductivity decreases rapidly with a decrease in density.

An atomized grade of copper powder (Alcan Grade 1856) to which a 0.5 weight percent lithium stearate was added was pressed and mixed in the same manner as the previous examples. The results are tabulated below.

| COMPACTING PRESSURE | IMPREGNANT AND CONCENTRATION | % VOIDS AS-SINTERED |
|---|---|---|
| 35 TSI | Lithium nitrate-25 grams/100 cc $H_2O$ | 4.9 |
| 45 TSI | Lithium nitrate-25 grams/100 cc $H_2O$ | 4.0 |
| 35 TSI | AHM-32 grams/100 cc $H_2O$ | 8.6 |
| 45 TSI | AHM-32 grams/100 cc $H_2O$ | Cracked |
| 35 TSI | None | Swelled |
| 45 TSI | None | Swelled |

Similar results are found with the other impregnants enumerated in the specification although the concentration of impregnant and sintering schedule may vary. For best results, the maximum amount of lithium nitrate is employed that will dissolve in the solvent, e.g., distilled water and impregnation conducted under a pressure above 1 atmosphere, e.g. 6 atmospheres.

Those skilled in the art will appreciate that the foregoing examples are meant to be illustrative of the invention but non-limiting except as defined by the appended claims for obvious and non-inventive modifications can be made without departing from the true scope of the invention.

I claim:

1. A method for improving the conductivity and density of pressed and sintered normally soft and reducible metal parts comprising treating a normally soft and reducible metal pressing having open pores with an impregnant that keeps the pores of the pressing open until substantially all internal gases are expelled and which itself can then be expelled at elevated temperature, removing the impregnant by subjecting the pressing to a sintering schedule comprising raising the temperature in stages, first to remove surface water, water of hydration from the impregnant and decompose the surface reaction products of the metal and atmosphere, secondly to expel substantially all gases from the metal, thirdly, to expel substantially all of the impregnant, and finally to close substantially all voids so as to increase both the density and electrical conductivity of the pressing wherein the method is conducted in the presence of hydrogen, CO, a vacuum or an inert gas purge sufficient to inhibit oxidation of the pressing.

2. The method of claim 1 wherein the pressing is formed of copper, gold, silver, platinum or their alloys.

3. The method of claim 1 wherein the pressing is formed of copper.

4. The method of claim 1 wherein the impregnant is selected from lithium nitrate and ammonium heptamolybdate.

5. The method of claim 1 wherein the impregnant is lithium nitrate.

6. The method of claim 5 wherein the pressing is copper.

7. The method of claim 1 wherein the sintering schedule comprises a first stage at a temperature of between about 60° C. and about 150° C. for a period of from about 5 minutes to about 30 minutes, a second stage at a temperature of between about 150° C. and about 425° C. for a period of from about 5 minutes and about 30 minutes, a third stage at a temperature of between about 450° C. and about 700° C. for a period between about 5 minutes and about 30 minutes, and a fourth stage at a temperture of between about 850° C. and about 1050° C. for a period between about 30 minutes and about 2 hours.

8. The method of claim 7 wherein the pressing is copper.

9. The method of claim 1 wherein the green pressing has a void volume of between 8 and 14 percent.

10. The method of claim 1 wherein the sintering is conducted in a hydrogen atmosphere.

11. The method of claim 1 wherein the voids are impregnated by submerging the pressing in a solution of impregnant in a vacuum chamber, the chamber evacuated for a period sufficient to remove substantially all of the air from the pores of the pressing, and the chamber backfilled with air at atmospheric or higher pressure to force the impregnant into the empty pores.

12. A method for improving the conductivity and density of pressed and sintered normally soft and reducible metal parts comprising treating a normally soft and reducible metal pressing having open pores with an impregnant that keeps the pores of the pressing open until substantially all internal gasses are expelled and which itself can then be expelled at elevated temperature, removing the impregnant by subjecting the pressing to a sintering schedule comprising raising the temperature in stages, wherein the sintering schedule comprises a first stage at a temperature of between about 50° C. and about 150° C. for a period of from about 5 minutes to about 30 minutes, a second stage at a temperature of between about 150° C. and about 450° C. for a period of from about 5 minutes and about 30 minutes, a third stage at a temperature of between about 450° C. and about 700° C. for a period between about 5 minutes and about 30 minutes, and a fourth stage at a temperature of between about 850° C. and about 1050° C. for a period between about 30 minutes and about 2 hours.

* * * * *